United States Patent [19]

LiCalsi

[11] 4,124,795

[45] Nov. 7, 1978

[54] FIRE PROTECTION CALCULATOR

[75] Inventor: Joseph LiCalsi, East Meadow, N.Y.

[73] Assignee: American District Telegraph Company, Jersey City, N.J.

[21] Appl. No.: 726,849

[22] Filed: Sep. 27, 1976

[51] Int. Cl.[2] ..... G06G 1/02; G06C 3/00

[52] U.S. Cl. ..... 235/70 A; 235/85 R; 235/89 R

[58] Field of Search ..... 235/70 A, 70 R, 85 R, 235/89 R

[56] References Cited

U.S. PATENT DOCUMENTS

| | | | |
|---|---|---|---|
| 3,120,342 | 2/1964 | Geiger | 235/70 R |
| 3,146,942 | 9/1964 | Gaudier-Pons | 235/70 R |
| 3,467,307 | 9/1969 | Levitt | 235/89 R |
| 3,627,199 | 12/1971 | Hill | 235/85 R |
| 3,712,974 | 1/1973 | Martin | 235/70 R |
| 3,795,795 | 3/1974 | Gulbransen, Jr. | 235/70 A |
| 3,814,308 | 6/1974 | Kolan | 235/70 A |
| 3,853,264 | 12/1974 | Hovarka | 235/70 A |
| 3,858,798 | 1/1975 | Feingold | 235/83 |

FOREIGN PATENT DOCUMENTS

| | | | |
|---|---|---|---|
| 647,895 | 11/1964 | Belgium | 235/70 A |

*Primary Examiner*—Stephen J. Tomsky
*Attorney, Agent, or Firm*—James F. Haley, Jr.

[57] ABSTRACT

A calculator and method for simply and quickly selecting appropriate spot type fire detectors and determining their preferred locations in a chosen space division in accordance with standard spacing ratings. The slide rule-like calculator includes a body member, a slide member slidably positioned within said body member, and in one embodiment a cursor slidably encompassing both the body member and slide member. The body member comprises at least one logarithmic scale representing one dimension of the space division and the slide member comprises at least one logarithmic scale representing the second dimension of the space division. Additionally, at least one fire detector scale, established with reference to standard space detector ratings, is included either on said body or slide member and an index or zero line is included on the other member. This calculator admits when constrained by the dimensions and ceiling type of the space to be protected of a simple accurate selection method for spot type fire detection devices of varied characteristics and capacities.

4 Claims, 5 Drawing Figures

FIRE PROTECTION CALCULATOR

BACKGROUND OF THE INVENTION

The present invention generally relates to slide rule-like calculators and more particularly to a slide rule-like calculator and method for quickly and simply selecting appropriate spot-type fire detector devices and determining their preferred locations in rooms of varied size and ceiling characteristic. Such calculator and method permit a ready, direct-reading comparison of varied spot-type fire protective schemes for a space of specified dimension and ceiling type.

The National Fire Protection Association, particularly in NFPA Standard No. 72E, Automatic Fire Detectors (1974), has established space rating requirements for spot-type fire detectors and preferred room locations for their installation. These space ratings, the maximum linear spacings between similar detectors, are determined by standard testing agencies, such as Underwriters Laboratories, Inc., and Factory Mutual Laboratories, Inc., in actual fire tests.

For example, a detector to be rated is positioned at one corner of an imaginary square, whose center is the fire location. The response of this detector is then compared to that of an ordinary sprinkler (160° F.) located at a similar corner of an imaginary 10 × 10 foot square about the central fire. The detector receives that rating, i.e. imaginary square size, at which it responds before the sprinkler to the heat of the central fire. Thus, detectors are rated on the basis of square patterns, e.g. a 30 ft. × 30 ft. detector, protects a smaller space division than a 40 ft. × 40 ft. detector.

As at least on smooth ceilings a fire spreads uniformly in all directions in an ever expanding circle, the actual protective coverage of a detector, rather than being an imaginary square of size S × S (space rating) is more correctly a circle circumscribed about the rating square. The diameter, D, of this fire protection circle, being the diagonal of the inscribed square, equals the square root of the sum of the square of the sides of the square in accordance with the following formula:

$$D = (S^2 + S^2)^{\frac{1}{2}} = (2S^2)^{\frac{1}{2}} = S(2)^{\frac{1}{2}}$$

It is important to note that such uniformity of fire spread and detector response to a central fire on a smooth ceiling having no beams or obstructions greater than 4 inches deep is not applicable to more specialized ceiling types where the spread of the fire is inhibited by the obstructions. Rather, beamed ceilings, having beams 4–18 inches deep, spaced greater than 3 feet apart, center to center, and joisted ceilings, having solid joists deeper than 4 inches and spaced less than 3 feet apart, center to center, require derating of the smooth ceiling determined space ratings and diameters. Such space rating reductions equal in standard calculations to one-third for beamed ceilings and one-half for joisted ceilings, this spacing reduction factor being applied to the dimension perpendicular to the beams. Moreover, for ceilings with beams deeper than 18 inches, no derating is sufficient and each bay must be treated as a separate area. Hence, any determination of a fire protective scheme must be effected only after consideration of room size, ceiling type and standarized space ratings.

In that many rooms are rectangular vice square in dimension, it should be realized that any rectangle of diagonal dimension equal to or less than the diameter D of the above described circle or its derated value in the special ceiling cases also resides within the rated protective zone. Thus, such maximum diagonal, the square root of the sum of the square of the length (A) and width (B) of the rectangular space equals the fire protective circle's diameter (D), previously calculated from the imaginary square of the space rating (S × S). This dual relationship is expressed mathematically as follows:

$$D = S(2)^{\frac{1}{2}} = (A^2 + B^2)^{\frac{1}{2}}$$

Such commonality of relationship between a given space rating and a specific rectangular size permits the measurement rectangulation and derating as necessary of a chosen space. The actual comparison of these trial rectangles with the the various space rating squares affords a determination of which size and number of space divisions best satisfy the limits or capabilities of protection of the various spot-type fire detectors. This division and comparative procedure adduces the selection of an appropriate fire protective scheme for the actual room and ceiling type confronted.

Formerly, this comparative selection process has consisted of an operator or estimator subdividing the areas to be protected into convenient rectangles or squares; measuring or estimating the sides of those space divisions; derating as appropriate that side perpendicular to any obstructions; determining the length of the diagonal of the space division; and comparing such diagonals with those determined from the space ratings of particular fire detectors. This process, given the infinite number of rectangular combinations and ceiling types possible in a room and the myriad protective schemes warranted by such variables involved repeated calculation and reference to numerous charts to reach the most effective and economic fire protective detector mix. Such process being time-consuming, tedious, and prone to mistake, often resulted in less than a full utilization of a detector's rated protective coverage.

SUMMARY OF THE INVENTION

It is thus an object of this invention to provide a slide rule-like calculator and method for quickly and efficiently selecting appropriate fire detector devices for spaces of varied size and ceiling type.

It is another object of this invention to provide a direct-reading, simplified means for comparing numerous possible space divisions to permit ready optimization of protection and economy.

It is a further object of this invention to permit accurate and full utilization of a detector's spacing capabilities to provide a cost effective installation.

It is still another object of this invention to automatically include those standard derating factors necessary for varied ceiling types and configurations in the simple selection of a protective scheme.

To achieve the above objects, as well as others which will become apparent from the following descriptions and figures, a slide rule-like calculator for spot-type fire detector selection, in accordance with this invention comprises in general a body member, comprising at least one logarithmic scale, representing one dimension of the specific space division, and preferably an index or zero line; and a slide member, slidably positioned within the body member, comprising at least a second logarithmic scale, representing the other dimension of the chosen space division, and preferably a fire detector scale established with reference to standard space detector ratings. The fire detector scale displays available fire detector devices. This scale permits the direct reading of that detector device deemed satisfactory under the chosen standards for protection of the particular space division. Preferably, those detector devices satisfactory to protect a chosen space under a particular industry standard are set out on a separate fire detector scale. These logarithmic scales, while representing the dimensions, length and width, of the chosen space are in fact suitably arranged to square the entered linear dimension. That is the spacing of the interlineations of each scale are proportional to 2 times the logarithm of the linear dimension but the interlineations are linear dimension labelled. Moreover, the second or slide member logarithmic scale preferably is arranged in relation to the logarithmic scale of the body member so as to include therein that derating factor applicable to major ceiling types, i.e. smooth, beamed or joisted. Thus, only linear dimensions need be employed to effect a protective scheme comparison and determination.

In general the procedure for use of the calculator involves the measurement or estimation of the respective dimensions of the space or a subdivision thereof to be protected. One of these measurements, in the case of a beamed or joisted ceiling, the dimension perpendicular to the beams or joists, is in the preferred embodiment entered on the sliding member scale by moving the slide within the body member so as to position this dimension along the index or zero line of the body member scale. Such slide movement likewise assures correct positioning of the slide member included fire detector scale. The second dimension is then entered on the body member scale by eye or in one embodiment with a cursor. This dimension entry point adduces a corresponding point on the previously positioned fire detector scale. Such latter position indicates the correct spot-type fire detector in central location for protection of the chosen space.

It is to be noted that such fire detector scale may alternatively be located on the body member. E.g. FIG. 5, Scales 21, 22, 23, 23*a*, 31*a* and 32. In this embodiment the slide member scale's index or zero line is positioned so as to align with a dimension of the space, in the case of a beamed or joisted ceiling the dimension perpendicular to said beams or joists, on the body scale. The second dimension, is then entered by eye or cursor on the sliding scale and the corresponding point on the fire detector scale indicates the appropriate fire protective device.

Repeating these sequences for other subdivisions or different combinations thereof permits the simple and accurate determination of the most efficient and economic fire protection scheme for the considered space.

DESCRIPTION OF THE PREFERRED EMBODIMENTS

Figure 1:
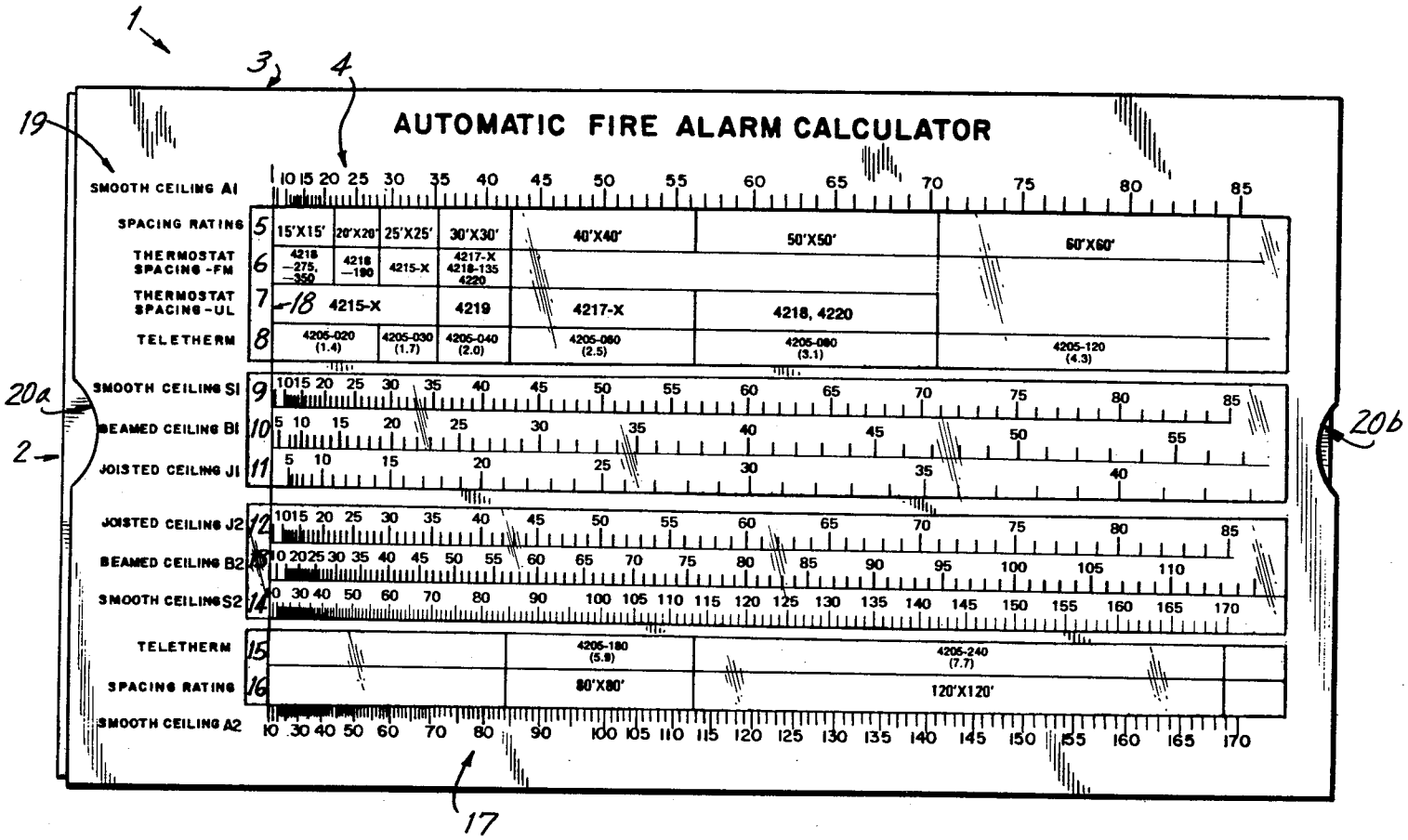
FIG. 1 is a top plan view of a fire protection calculator in accordance with this invention showing the slide member stored within the body member.
Figure 2:
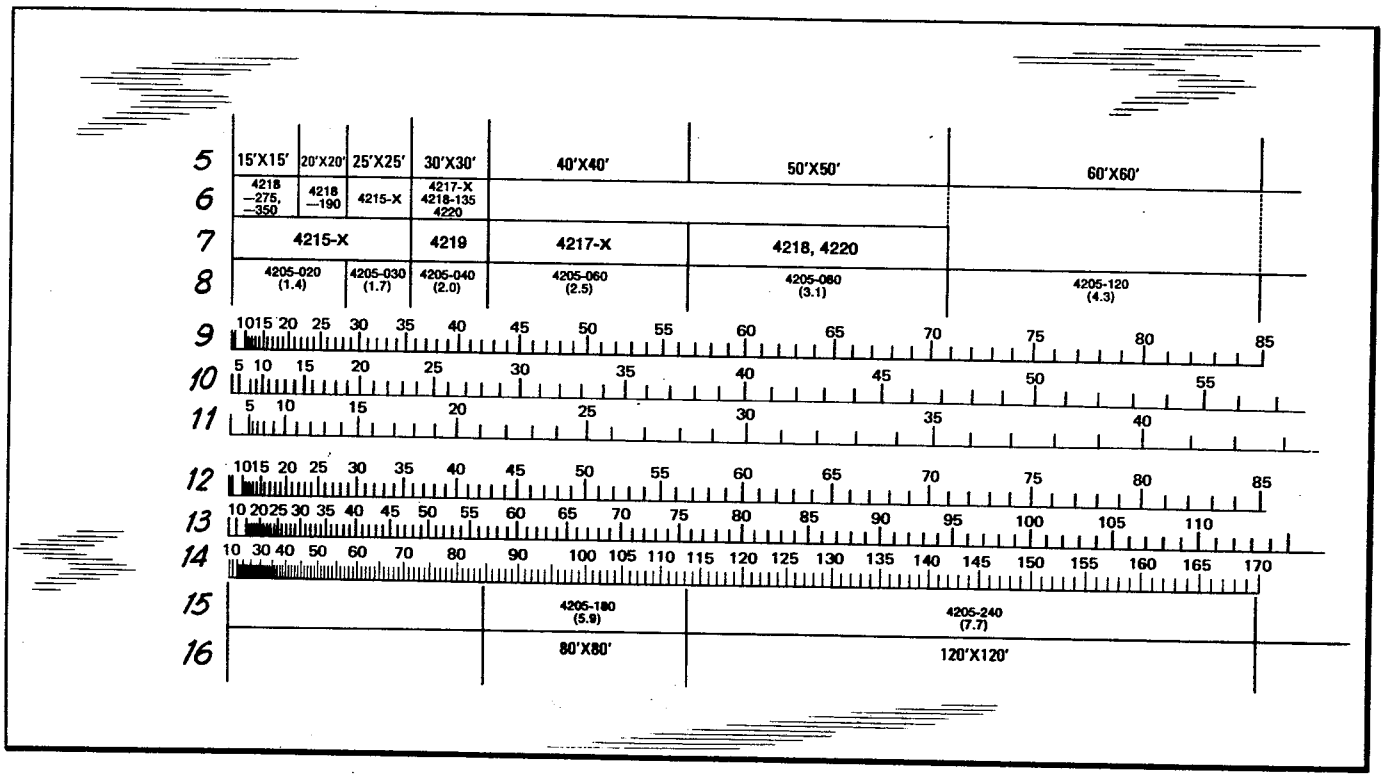
FIG. 2 is a top plan view of the slide member of the calculator of FIG. 1.
Figure 3:
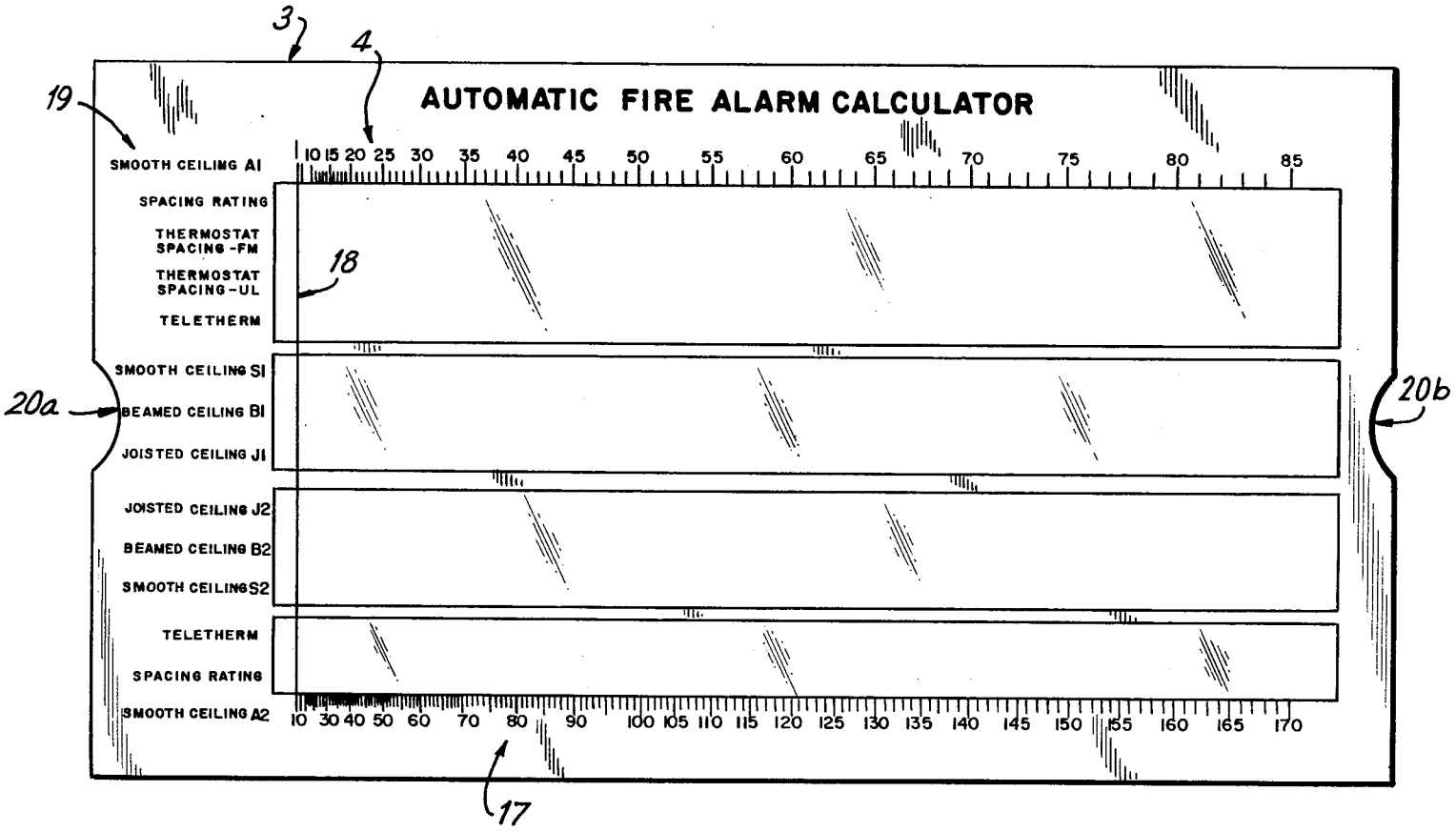
FIG. 3 is a top plan view of the body member of the calculator of FIG. 1.

Referring now to FIG. 1 the slide rule-like calculator 1 in accordance with the invention comprises a slide member 2 (shown alone in FIG. 2) and a body member 3 (shown alone in FIG. 3). The slide member in the embodiment depicted includes three logarithmic scales 12, 13 and 14, corresponding to ceiling types, joisted, beamed and smooth respectively. Further, such member includes logarithmic scales 9, 10 and 11 serving to expand the lower portions of scales 12, 13 and 14 to afford better accuracy in these smaller dimensional ranges. In addition, the slide member includes scales 5 and 16 depicting standard space ratings, scale 6 for specific thermostat spacing under Factory Mutual standards, scale 7 for thermostat spacing under Underwriter's Laboratory standards and scales 8 and 15 depicting Teletherm (a registered trademark of the American District Telegraph Company for a thermoelectric fire detection system) selections.

The body member 3, in the embodiment depicted, includes two logarithmic scales 4 and 17, scale 4 being an expansion of the lower portion of scale 17, an index or zero line 18, identifying titles 19 corresponding to slide member scales 5–16, and cutouts 20*a* and 20*b* to permit easy access to the slide member.

It should be noted that upper scales 4–11 are used solely in conjunction with each other in a similar fashion to lower scales 12–17.

Figure 4:
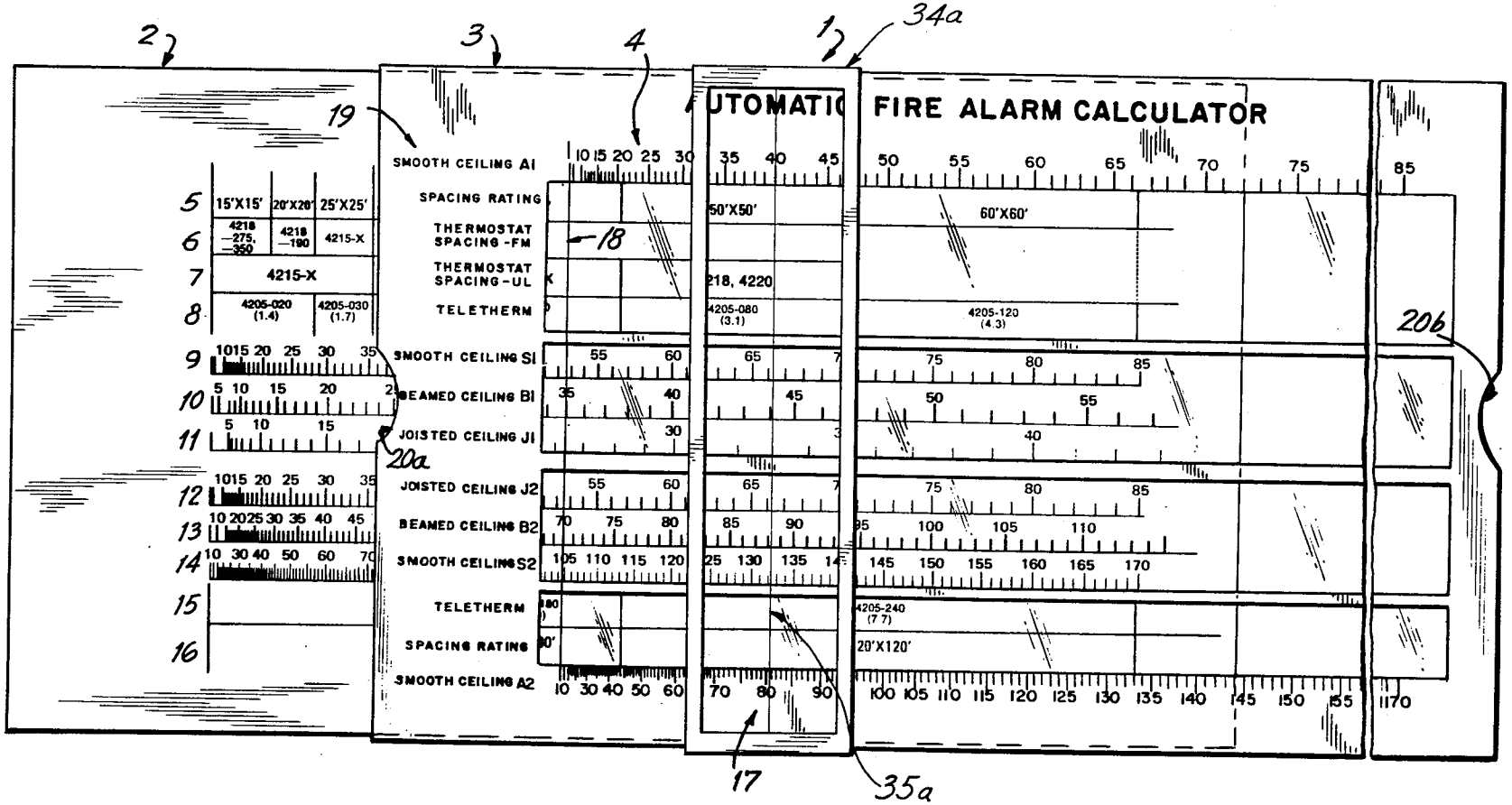
FIG. 4 is a top plan view of the fire protection calculator of FIG. 1, including a cursor not shown in FIG. 1, wherein the slide member has been positioned along the body member index or zero line to correspond to a beamed ceiling space having 35 feet as the dimension perpendicular to the beams and the cursor has been positioned to correspond to a second ceiling dimension of 40 feet along scale 4.

FIG. 4 illustrates the application of fire protection calculator 1 to the selection of an appropriate fire detection device for a space having a beamed ceiling determined to have dimensions 35 feet by 40 feet. The standard derating factor of two-thirds for ceilings having beams 4–18 inches deep and spaced greater than 3 feet apart, center to center, has already been included in beam ceiling scale 10. Both dimensions being within the limits of upper scales 4–11, the slide is moved to the left as illustrated so as to position the 35 interlineation on scale 10 under the index line 18 of the body member. It should be noted that dimensions entered on this scale, like those of scale 13 and joisted ceiling scales 11 and 12 represent those dimensions perpendicular to the beams and joists, respectively. Following this positioning, the upper scale 4 of the body member is entered to locate the second dimension (40), such location being done by eye or by cursor 34*a* and hairline 35*a*. This entry allows selection of the corresponding space rating, thermostat and Teletherm selections from scales 5–8, respectively, for the chosen space and ceiling type. Thus, moving downwards from the (40) dimension point, it is seen that the spacing rating on scale 5 is 50 ft. × 50 ft., indicating that a 50 ft. × 50 ft. rated detector will satisfy the protection constraints of the space. Continuing down to scale 6 reveals that no thermostat is appropriate under Factory Mutual standards to protect the space. However, under Underwriter's Laboratories standards, a 4218 or 4220 thermostat (scale 7) is usable in this area. Additionally, scale 8 displays that the appropriate Teletherm (TM) for the space is a 4205-080. The 4200 series of model numbers are in accordance with the standard device identification system used by the American District Telegraph Company.

Figure 5:
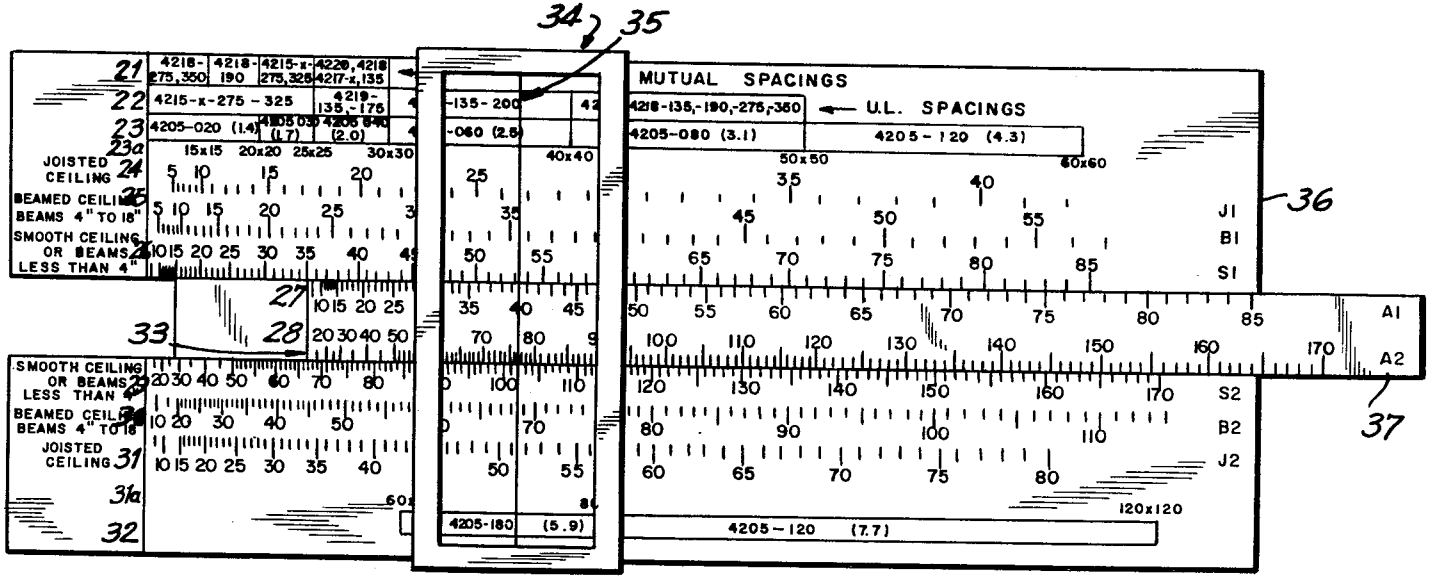
FIG. 5 is a top plan view of another embodiment of a fire protective calculator in accordance with this invention wherein the slide member has been positioned by its index or zero line along the body member to correspond to a smooth ceiling space having 40 feet as one dimension and the cursor has been positioned along the slide member to correspond to the other space dimension of 35 feet.

FIG. 5 depicts the application of another embodiment of a fire protection calculator in accordance with this invention to the selection of an appropriate fire detector device for a space having a smooth ceiling, i.e. a flat ceiling with any obstructions or beams less than 4 inches, of dimensions 35 ft. × 40 ft.

In this embodiment the slide member 37 includes two logarithmic scales 27 and 28, corresponding to one linear dimension of the space, scale 27 being an expansion of the lower portion of scale 28, and an index or zero line 33. The body member 36 includes upper scales 21-26 and lower scales 29-32 corresponding to the upper and lower scales, of the slide member 2 in FIG. 1 and FIG. 2. In addition body member 36 includes space rating scales 23*a* and 31*a*. These correspond to space rating scales 5 and 16, respectively, of slide member 2 of FIGS. 1 and 2.

Applying this calculator to the given space, the slide member 37 is moved to the right so as to align its index or zero line 33 with linear dimension 35 on upper smooth ceiling scale 26, the upper scale series being used as both room dimensions are included therein. Having correctly positioned the slide, the cursor 34 is positioned as illustrated to align its hair line 35 with the second room dimension 40 on upper slide member scale 27. The side position corresponding to the extension of hair line 35 on scales 21–23 and 23*a* indicates the appropriate spot-type protection device for the chosen space size and ceiling type. Thus scale 21 indicates that the 35 ft. × 40 ft. area is beyond the range of Factory Mutual spacings for thermostats, scale 22 displays that thermostats 4217-*x*, −135, −200 may be used under the Underwriter's Laboratory spacing, scale 23 indicates that a 4205-060 device of the thermoelectric fire detection system may be employed and space rating scale 23*a* indicates that a detector having a 30×30 space rating is sufficient to protect the chosen space division.

Although in the embodiments described the fire protection calculator of this invention has been rectangular in shape, such calculator in circular or other form is likewise included within the description.

Numerous other alterations of the structure and method herein described will suggest themselves to those of skill in the art. However, it is to be understood that such are within the following claims.

I claim:

1. A calculator for selecting appropriate spot-type fire protective devices for a space division of predetermined dimension and ceiling type comprising: a body member carrying two logarithmic scales extending therealong, one of said scales being an expansion of the lower end of the second of said scales, and an index line located at the zero positions of said scales, the interlineations of said scales representing one dimension of said space division and the spacing of these interlineations being arranged in proportion to the square of said dimension; and a slide member, slidably positioned within said body member and carrying two sets of scales extending therealong, one set being an expansion of the lower portion of the second set, each set comprising three logarithmic scales and at least one fire detector scale established with reference to standard space detector ratings, one of said logarithmic scales corresponding to each of ceiling types smooth, beamed and joisted, the interlineations of said logarithmic scales representing the other dimension of said space division and the spacing of these interlineations being arranged in proportion to the square of the dimension as derated by that derating factor appropriate for said ceiling type, the dimension of the space division represented by the interlineations of the slide member logarithmic scales corresponding to ceiling types beamed and joisted being the dimension of the space division perpendicular to the beams and joists respectively of said ceiling types.

2. The calculator of claim 1 including a cursor slidably encompassing both said body and said slide members.

3. A calculator for selecting appropriate spot-type fire protective devices for a space division of predetermined dimension and ceiling type comprising: a body member carrying two sets of scales extending therealong, one set being an expansion of the lower portion of the second set, each set comprising three logarithmic scales and at least one fire detector scale established with reference to standard space detector ratings, one of said logarithmic scales corresponding to each of ceiling types smooth, beamed, and joisted, the interlineations of said logarithmic scales representing one dimension of said space division and the spacing of these interlineations being arranged in proportion to the square of the dimension as derated by that derating factor appropriate for said ceiling types the dimension of the space division represented by the interlineations of the body member logarithmic scales corresponding to ceiling types beamed and joisted being the dimension of the space division perpendicular to the beams and joists respectively of said ceiling types; and a slide member, slidably positioned within said body member and carrying two logarithmic scales extending therealong, one of said scales being an expansion of the lower end of the second of said scales and an index line located at the zero positions of said scales, the interlineations of said logarithmic scales representing the other dimension of said space division and the spacing of these interlineations being arranged in proportion to the square of said dimension.

4. The calculator of claim 3 including a cursor slidably encompassing both said body member and said slide members.

* * * * *